United States Patent [19]

Ishikawa

[11] Patent Number: 5,017,085

[45] Date of Patent: May 21, 1991

[54] METHOD AND APPARATUS FOR SEPARATING PAPER SHEETS INTO UNITS AND DISTRIBUTING THEM

[75] Inventor: Makoto Ishikawa, Fuji, Japan

[73] Assignee: Maruishi Iron Works Co., Ltd., Shizuoka, Japan

[21] Appl. No.: 435,998

[22] Filed: Nov. 14, 1989

[51] Int. Cl.[5] ..... B65H 3/24; B65H 3/50

[52] U.S. Cl. ..... 414/796; 414/786; 414/796.8

[58] Field of Search ..... 414/786, 796, 796.7, 414/796.8, 796.5, 796.9; 271/128

[56] References Cited

U.S. PATENT DOCUMENTS 4,551,053 11/1985 Ishibashi ..... 414/796
4,623,292 11/1986 Suzuki et al. ..... 414/796

FOREIGN PATENT DOCUMENTS 3612780 10/1987 Fed. Rep. of Germany ..... 414/796
61-188342 8/1986 Japan .

*Primary Examiner*—F. J. Bartuska
*Assistant Examiner*—Janice Krizek
*Attorney, Agent, or Firm*—Oblon, Spivak, McClelland, Maier & Neustadt

[57] ABSTRACT

An apparatus for separating a pile of paper sheets into units and distributing them is equipped with a separating device adapted to separate a pile of paper sheets into reams in accordance with markers provided on the pile. The apparatus is also equipped with a distributing device including a number of forks, which are inserted into a gap that is formed by the separating device between a ream of paper sheets to be separated from the pile and the rest of the pile, whereby at least one of the forks is first moved horizontally in a direction perpendicular to the ream-distributing direction, and then all the forks are moved in the ream-distributing direction. The markers consist of ream-marker tapes, and the separating device consists of an insertion member and a device for raising the ream-marker tapes, the insertion member being inserted into the pile using the lower surface of each ream-marker tape as a guide. When distributing reams of paper sheets, the insertion member is brought under a ream to be separated and distributed while the previous ream is being distributed, thus shortening the operation cycle.

7 Claims, 9 Drawing Sheets

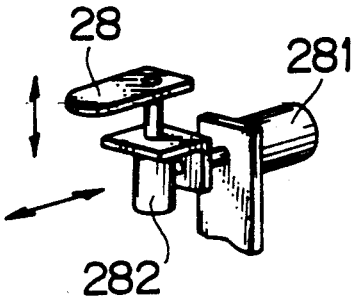
FIG.16
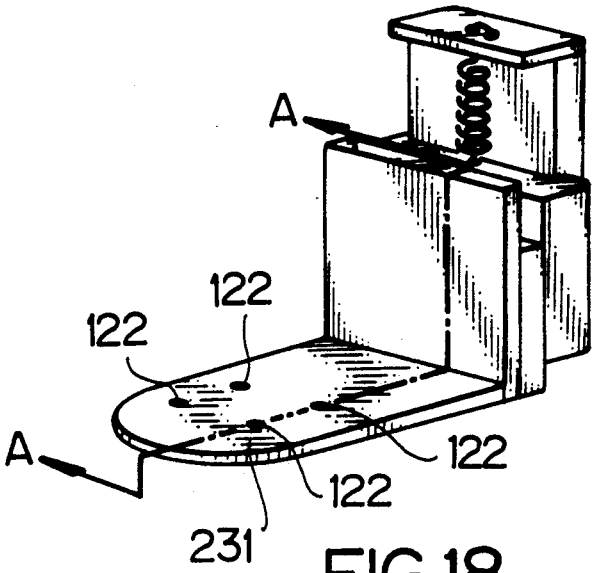
FIG.18
FIG.17
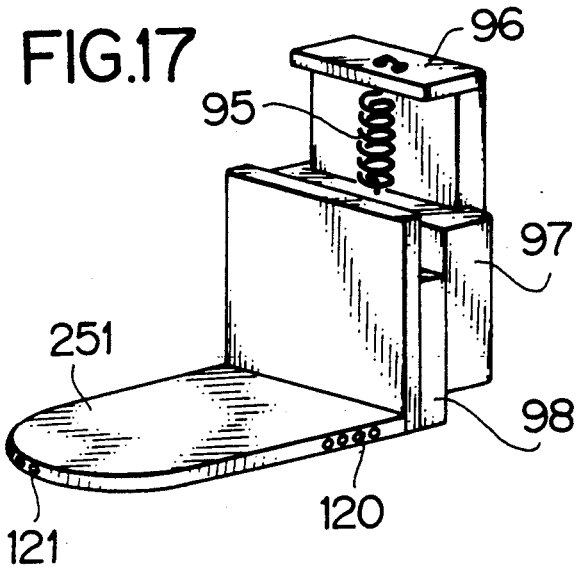
FIG.19
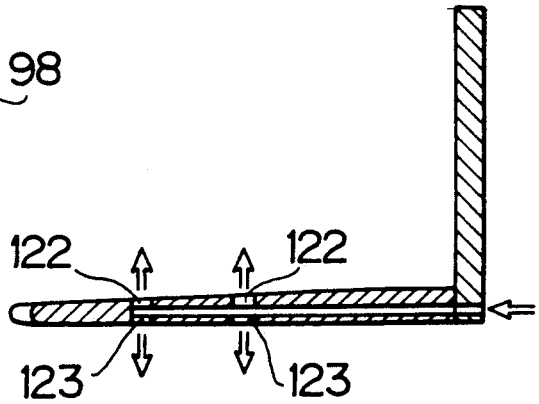
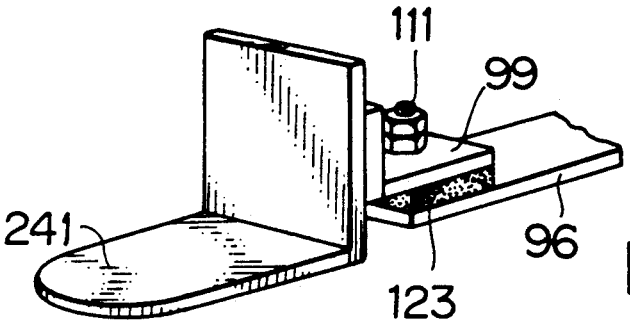
FIG.20

METHOD AND APPARATUS FOR SEPARATING PAPER SHEETS INTO UNITS AND DISTRIBUTING THEM

BACKGROUND OF THE INVENTION

1. Field of the Invention

This invention relates to a method and apparatus for separating paper sheets into units and distributing them. The paper sheets to be separated into units and distributed by the apparatus and method of this invention are equipped with markers for grouping them into units, each of which consists of a predetermined number of sheets.

2. Description of the Prior Art

Japanese Laid-Open Patent No. 61-188342 discloses a method and apparatus for separating paper sheets into units and distributing them.

The above-mentioned prior art apparatus comprises: a raising means for raising paper sheets having ream-marker tapes for grouping them into units, each containing a predetermined number of sheets; a separation means for vertically separating paper sheets in accordance with the ream-marker tapes; and a distribution means for distributing the paper sheets thus separated into units by the separation means. The separation means includes an insertion head equipped with suction holes for attracting the ream-marker tapes and an insertion tongue. A plurality of forks are inserted into a paper gap made in a pile of paper sheets by raising a unit of paper sheets from the pile by means of the insertion tongue. The forks are then moved forwards, thus distributing paper sheets by the unit.

However, the above-described apparatus has the following problem: it is not possible to form between the paper sheets a space wide enough to smoothly admit the plurality of forks (arranged at predetermined spaces on both sides of the apparatus) solely by raising paper sheets by means of the insertion head. This is particularly true when the paper sheets are relatively large.

Furthermore, the insertion head of the above-mentioned separation means is designed to attach to the ream-marker tapes by means of vacuum suction holes provided on the lower surface thereof, so that, when the insertion tongue is being inserted into a paper gap over a ream-marker tape, it is likely to hit against the paper sheet which is immediately above the ream-marker tape, thereby damaging this paper sheet. Thus, the separation of paper sheets cannot be performed in a satisfactory manner with this prior art apparatus.

As for the above-mentioned prior art method of separating paper sheets into units and delivering them, it comprises the following steps: first, a pile of paper sheets having ream-marker tapes for grouping them into units is raised to a certain height. The raising movement is stopped when a ream-marker tape is detected, and the insertion head is inserted into the pile at the position indicated by the ream-marker tape. Afterwards, the insertion head is further raised to form a gap in the pile, into which the distributing forks are inserted. Finally, the distributing forks are moved forwards, thus distributing paper sheets by the unit. Thus, this prior art method necessitates a rather long operation cycle.

SUMMARY OF THE INVENTION

It is accordingly an object of this invention to provide an improved apparatus for separating paper sheets into units and distributing them.

A second object of this invention is to provide a novel separation means for separating paper sheets into units each of which consists of a predetermined number of sheets.

A third object of this invention is to provide a novel distribution means for distributing paper sheets separated into units.

A fourth object of this invention is to provide a novel method of separating paper sheets into units and distributing them of the type in which paper sheets are separated into units and distributed in accordance with markers.

These and other objects are achieved according to the present invention by providing an apparatus for separating paper sheets into units and distributing them, comprising: a raising means for raising to a certain height a pile of paper sheets having markers for grouping them into reams; a separation means for vertically separating the pile of paper sheets into reams in accordance with the markers; and a distribution means having a plurality of forks to be inserted into a gap which is formed between a ream of paper sheets separated from the pile by the separation means and the rest of the pile, at least one of the plurality of forks being first moved horizontally in a direction perpendicular to the direction in which the ream is distributed, and all of the plurality of forks being moved afterwards in the direction in which the ream is distributed.

The second object of this invention can be achieved according to this invention by providing a separation means comprising an insertion member and a member for raising ream-marker tapes.

Further, in accordance with this invention, a plurality of forks are inserted into a gap formed below a ream of paper sheets separated from a pile of paper sheets by the separation means, and at least one of the plurality of forks is moved horizontally in a direction perpendicular to that in which the paper sheets are conveyed by the forks. Afterwards, the plurality of forks are all moved in the ream-distributing (conveying) direction, thereby achieving the third object of this invention.

The fourth object of this invention is achieved by providing a step in which, while a ream of sheets are being distributed through the forward movement of the distribution forks, the insertion member is inserted under the ream of sheets to be distributed next.

BRIEF DESCRIPTION OF THE DRAWINGS

FIG. 16 is a perspective view of a paper fixing member;

FIG. 17 is a perspective view of a fork which can move in the vertical direction;

FIG. 18 is a perspective view of a vertically movable fork in accordance with another embodiment of this invention;

FIG. 19 is a sectional view taken along the line A—A of FIG. 18; and

FIG. 20 is a perspective view of a vertically movable fork in accordance with still another embodiment of this invention.

DESCRIPTION OF THE PREFERRED EMBODIMENTS

Embodiments of this invention will now be described with reference to the attached drawings.

Figure 1:
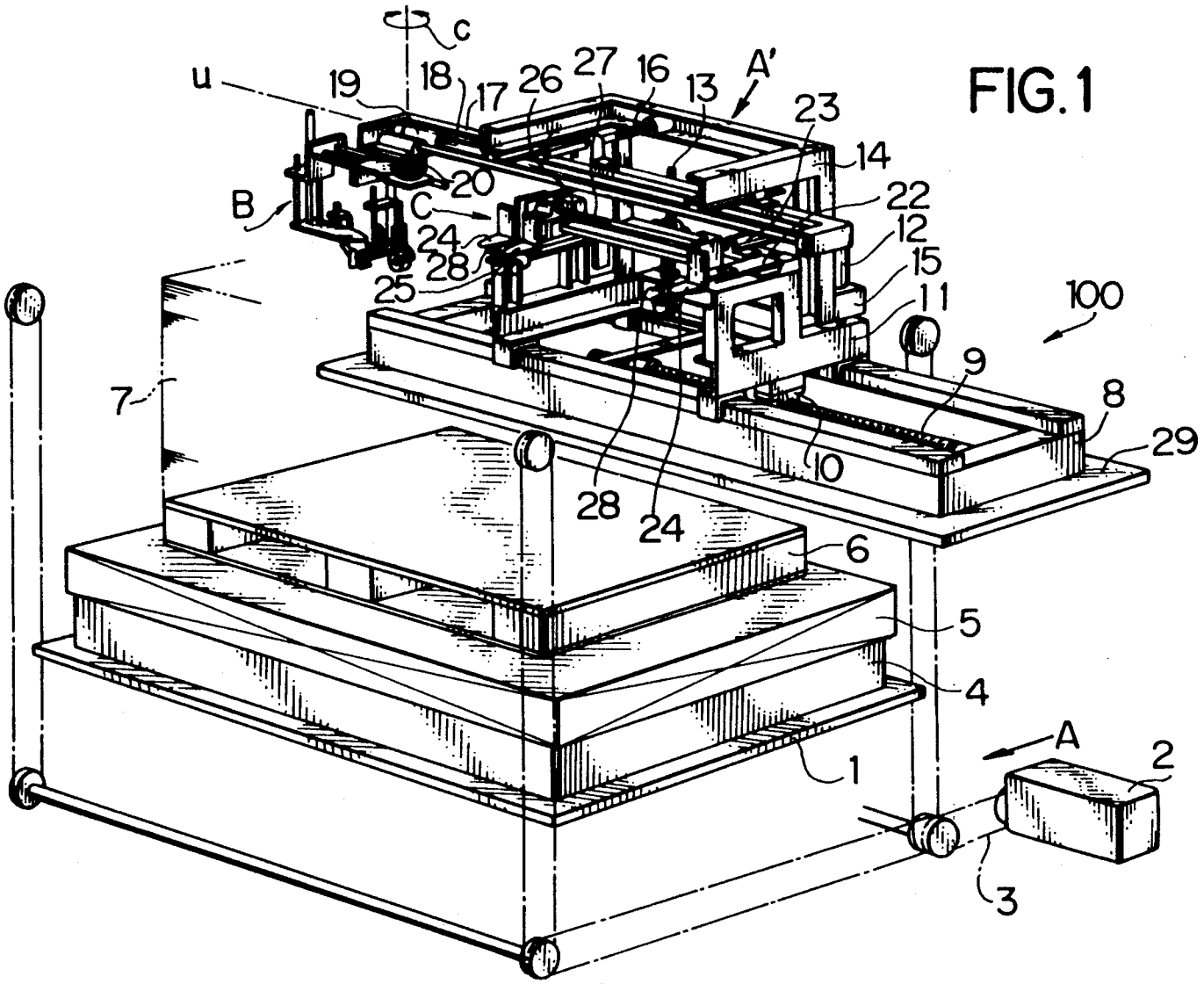
FIG. 1 schematically shows an apparatus in accordance with this invention.
Figure 4:
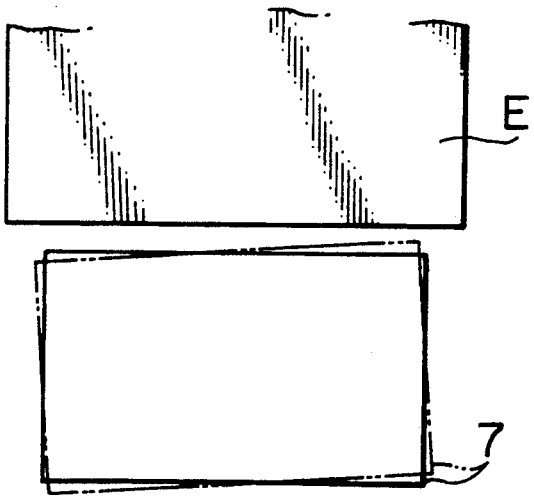
FIG. 4 shows the positional relationship between a pile of paper sheets and a ream wrapping machine.

Referring to FIG. 1, reference numeral 100 indicates an apparatus in accordance with this invention which is adapted to separate a pile of paper sheets 7 into units (reams) and to convey them to a ream wrapping machine E (FIG. 4) for wrapping them.

Schematically, the apparatus 100 comprises a raising means A for raising a pile of paper sheets, a separation means B for separating units of sheets from the rest of the pile, and a distribution means C for distributing the units thus separated.

Figure 2:
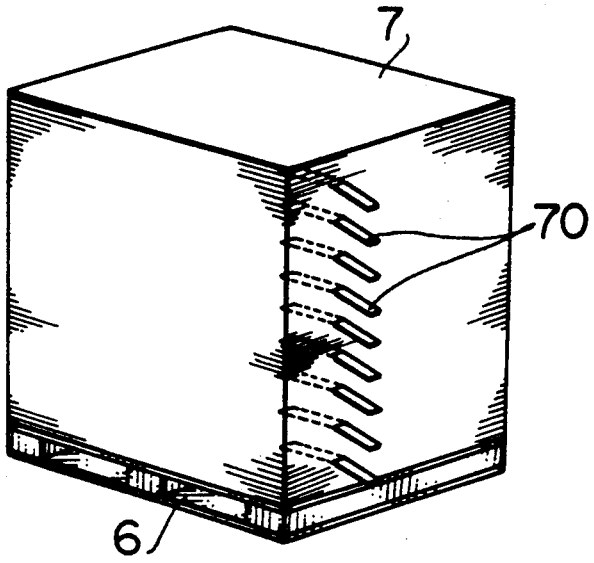
FIG. 2 shows a pile of paper sheets having ream-marker tapes as placed on a pallet.

The raising means A serves to raise a pile of sheets to a certain height. The sheets are equipped with markers for grouping them into reams, for example, ream-marker tapes 70 (FIG. 2). The markers may be paper tapes having ink markings or the like on their surfaces. Specifically, the raising means may have the following construction:

It may comprise: a servo motor 2 for raising and lowering a pallet 6; a chain 3; a lifter 1 connected to the chain 3; a table 4 provided on the lifter 1; a conveyor 5 provided on the table 4; and so on. The conveyor 5 serves to insert and extract the pallet 6 into and out of the apparatus when the lifter 1 is at its lowest position. The position of the paper sheets 7 is adjusted by the table 4, any twisting (FIG. 4) or deflection with respect to the perpendicular (FIG. 5) of the paper sheets 7 being detected by sensors (not shown).

The positioning on the side of the apparatus is performed by means of a positioning device A′ (see FIG. 1).

This positioning device A′ comprises a frame 8 serving as the base thereof, an X-axis unit 11, a screw 9 and a nut 10, the X-axis unit 11 being moved longitudinally along the frame 8 by means of the screw 9 and the nut 10. The positioning device A′ further comprises a screw 13 fixed to the X-axis unit 11, a Z-axis unit 14, a guide 12 and a slider 15. The screw 13 is operated by a handle (not shown) when moving the Z-axis unit 14 in the vertical direction. This arrangement allows the Z-axis 14 to slide vertically on the X-axis unit 11.

Further, a screw 16 is fixed to the Z-axis unit 14. By operating this screw 16 by a handle (not shown), a Y-axis unit 17 slides in a direction perpendicular to the X-axis. Fixed to the Y-axis unit 17 is a guide 18 along which a slider 19 can be moved longitudinally (along a U-axis which is parallel to the X-axis). The U-axis is used only when the separation means B is operated.

Figure 6:
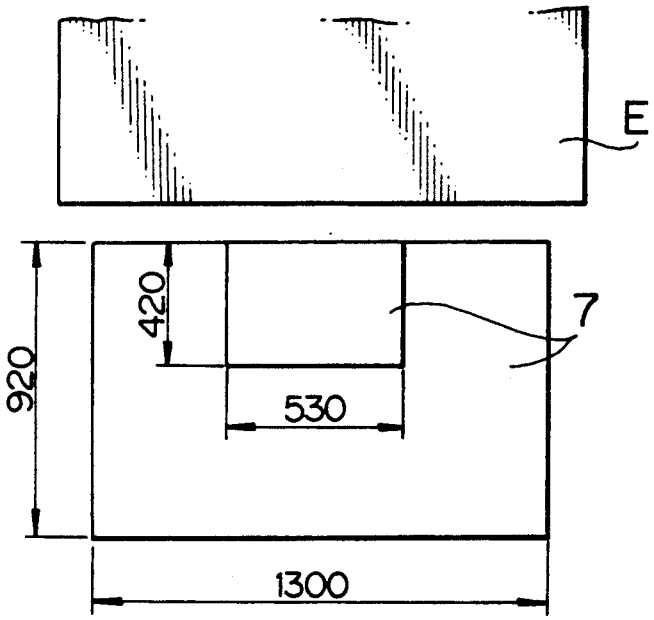
FIG. 6 is a dimensional drawing showing the variation in size of a pile of paper sheets.
Figure 7:
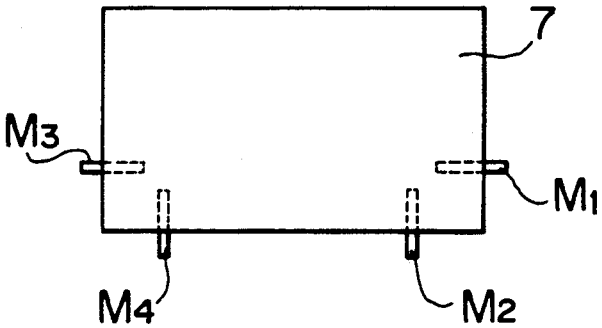
FIG. 7 shows an arrangement of ream-marker tapes.

The distribution means C can be set at a desired position on the X-axis along with the separation means B by operating a handle (not shown). This arrangement is in correspondence with the fact that the size of the paper sheets varies in a very wide range from 420×530 mm to 920×1300 mm (FIG. 6), as well as with the fact that, even with sheets of the same size, the position of each of the ream-marker tapes 70 on the sheets is not fixed but is to be selected from among the four different positions $M_1$, $M_2$, $M_3$, $M_4$ on them (FIG. 7).

The positioning device A′ is further equipped on both sides with paper fixing members 28 for fixing the rest of pile so that it will not move when a ream of sheets is being distributed. One of the two paper fixing members 28 is selected for use in accordance with the position of the ream marker tapes 70, which can be $M_1$, $M_2$, $M_3$, or $M_4$ of FIG. 7. As shown in FIG. 16, the paper fixing member 28 is equipped with a horizontal air cylinder 281 and a vertical air cylinder 282, which allow it to move in the horizontal direction and the vertical direction, respectively.

The frame 8 of the positioning device A′ is mounted on a stage 29. Since the size of the paper sheets 7 varies greatly, as shown in FIG. 6, and the distance between the ream wrapping machine E and the paper sheets 7 is to be kept constant by means of the table 4 for positioning the paper sheets 7, the stage 29 is moved longitudinally in accordance with these factors. As a result, the distance between the positioning device A′ and the paper sheets 7 is also kept constant. Even when the paper feeding operation is performed by hand without using the apparatus, this stage 29 is controlled in a similar manner to secure a satisfactory operational efficiency.

The separation means B serves to separate the paper sheets raised by the raising means A into reams in accordance with the markers. Specifically, the separation means B may have the following construction (see FIG. 8):

The separation means B may comprise a separation-unit-connecting plate 50 which is connected to the positioning device A′ through an indexing unit 20 (FIG. 1). Fixed to the separation-unit-connecting plate 50 is an insertion air cylinder 51 by means of which an insertion-head-mounting plate 53 is moved in the direction indicated by the arrows S—S. Reference numeral 561 indicates an insertion member which is composed, for example, of an insertion head 56 and a tongue 57. The insertion head 56 and the tongue 57 may be formed as separate components. Guides **52*a* and 52*b* serve to receive loads. Fixed to the insertion-head-mounting plate 53 is an air cylinder 54 for raising and lowering the insertion head 56. Guides 55*a* and 55*b* serve to receive loads. The insertion head 56, equipped with a tongue 57, is inserted into a pile of paper sheets where ream-marker tapes 70 are provided (The markers may be paper tapes having ink markings or the like on their surfaces) so as to vertically separate the pile into reams in accordance with the markers. In order to avoid damage to the paper sheets as far as possible, the insertion head 56 is inserted into the pile along the lower surface of each ream-marker tape 70 following the tongue 57. Fixed to the insertion head 56 is a marker holder 58 in the form of an air cylinder, by means of which each ream-marker tape 70 is pressed from above when the insertion head 56 is inserted into the pile of paper sheets 7, thereby making it possible to reliably draw out each ream-maker tape 70 when extracting the insertion head 56 from the pile of paper sheets 7**.

The separation means B is further equipped with a tape sensor 69 (e.g., a photoelectric switch) for confirming the extraction of tapes 70 from the pile.

Figure 5:
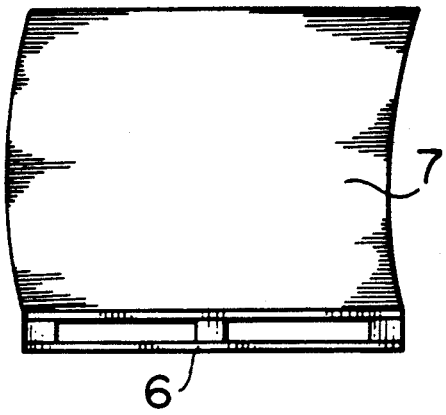
FIG. 5 shows a pile of paper sheets as placed on a pallet.

A pressing plate 66 is connected to the separation-unit-connecting plate 50 through the intermediary of a slider 65. A roller 68 is fixed to the pressing plate 66, and a spring 67 is provided between the plates 50 and 66. Accordingly, the roller 68 is pressed against the side surface of the pile of paper sheets 7, and, even when the pile of paper sheets 7 is deflected with respect to the perpendicular as shown in FIG. 5, the pressing plate 66 is positioned at a constant distance from the pressing point of the roller 68.

The separation means B is further equipped with light emitters 60*a*, 60*a* and light receivers 60*b*, 60*b* of the mark sensors. While in FIG. 8 the path of light between the light emitters 60*a*, 60*a* and the light receivers 60*b*, 60*b* of the mark sensors is partly omitted, this path is fixed with respect to the pressing plate 66.

Further, instead of the spring 67, a component having the same function, for example, an air cylinder, can be employed.

Figure 8:
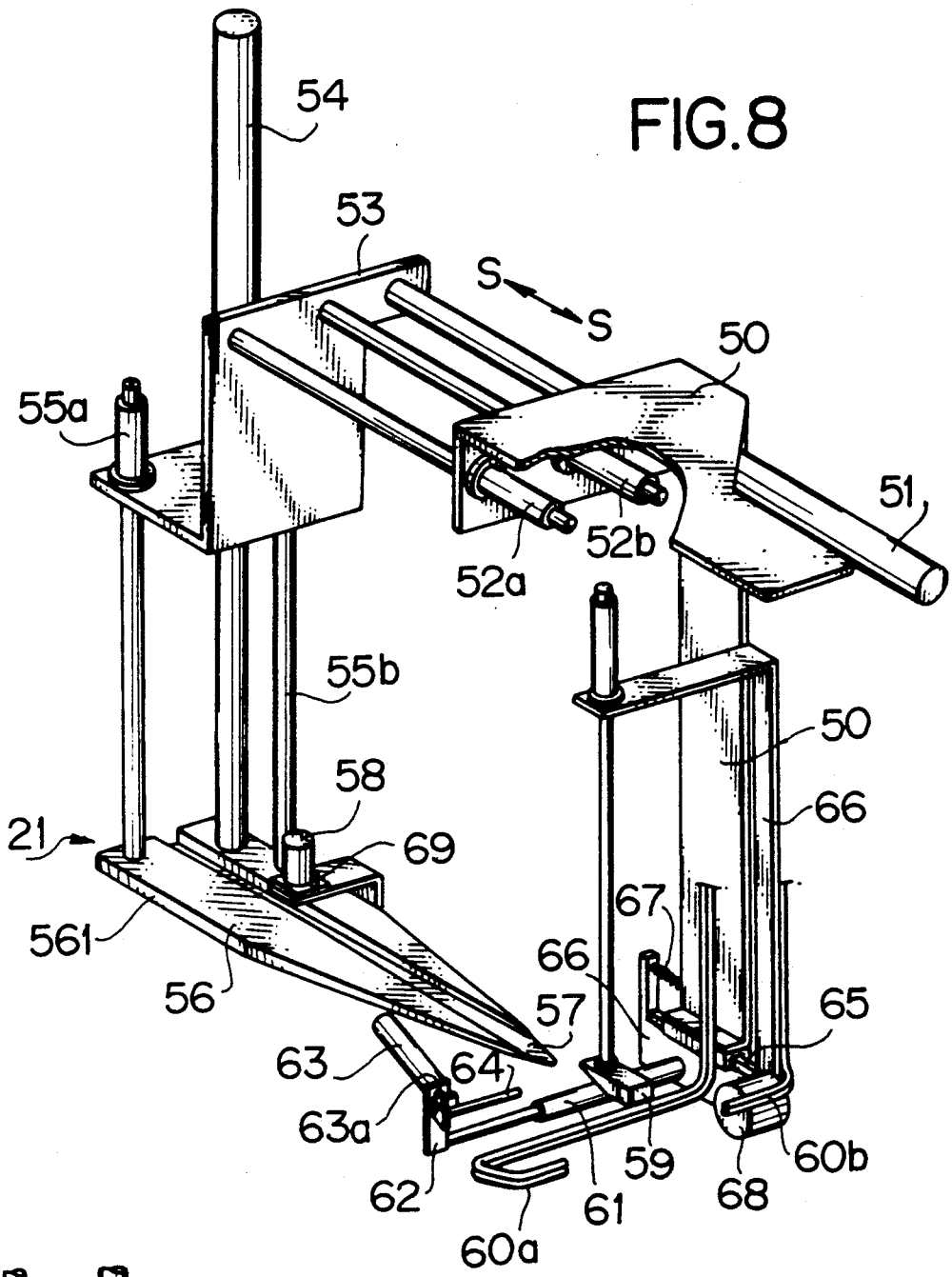
FIG. 8 is a perspective view of a separation means in accordance with an embodiment of this invention.
Figure 10:
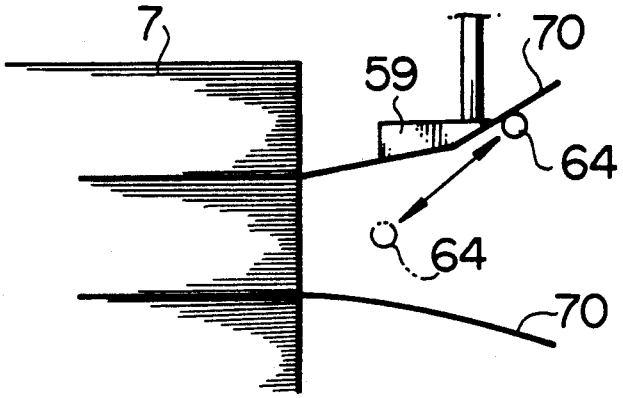
FIG. 10 shows the operation of a member for raising ream-marker tapes.
Figure 11:
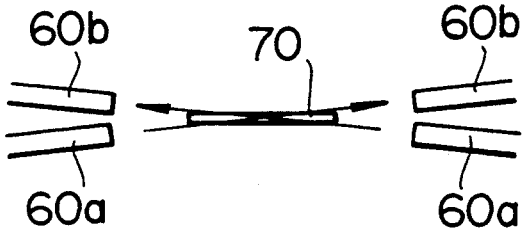
FIG. 11 shows an arrangement of mark sensors.

The following components are connected to the pressing plate 66: a tongue guide 59 which not only serves as a guide for the tongue 57 but is adapted to control the ream-marker tapes 70 from above; the light emitters 60*a*, 60*a* and the light receivers 60*b*, 60*b* of the mark sensor for determining the position where the raising means A is to be stopped when it ascends, bringing a marker to a position between them as shown in FIG. 11; a holder 64 adapted to bring the ream-marker tapes 70 into contact with the tongue guide 59 and to raise the tapes 70, thereby facilitating the insertion of the insertion head 56; an air cylinder 63 for raising the holder 64 so as to bring it to a position immediately below the ream-marker tapes 70; and a holder connecting plate 62 for connecting the air cylinder 63 to the holder 64. The holder 64 and the holder-drive air cylinder 63 are connected to each other through a rod 63*a*. The holder connecting plate 62 and the holder-drive air cylinder 63 are inclined with respect to the insertion head 56 (FIG. 8). This arrangement is made in order that the holder 64 may be moved from the position indicated by the broken line of FIG. 10 to that indicated by the solid line, thereby flipping the ream-marker tapes 70 obliquely upwards.

While this embodiment employs a tongue guide 59 and a holder 64 as the means for holding the ream-marker tapes 70, the ream-marker tapes 70 may also be held by some other means, for example, by means of a suction hole (not shown) provided on the lower surface of the tongue guide 59.

These means for holding the ream-marker tapes 70 are kept at a constant distance from the side surface of the pile of paper sheets 7, which means the light emitters 60*a*, 60*a* and the light receivers 60*b*, 60*b* can be positioned in close proximity to the side surface of the pile of paper sheets 7. Accordingly, errors in the ascent and stopping of the pallet due to drooping tapes or the like can be avoided to the utmost. The tongue guide 59 can also be positioned at an optimum distance from the side surface of the pile of paper sheets 7. Since the mark sensors are designed such that the beams of light from the light emitters 60*a*, 60*a* to the light receivers 60*b*, 60*b* are substantially in the same direction as the plane of the ream-marker tapes 70 (paper tapes), there is the danger of tapes not being detected when they are relatively thin. In view of this, at least two pairs of transmission-type photoelectric switches are arranged in such a manner that their beams cross each other. If either one of them detects one of the ream-marker tapes 70, the lifter ceases to ascend. This is illustrated in FIG. 11. Thanks to this arrangement, even thin ream-marker tapes 70 can be detected reliably.

FIGS. 12*a* to 12*e* illustrate how the insertion head 56 is inserted into the pile of paper sheets 7 as it is guided by one of the ream-marker tapes 70. This operation will now be described.

Figure 12A:
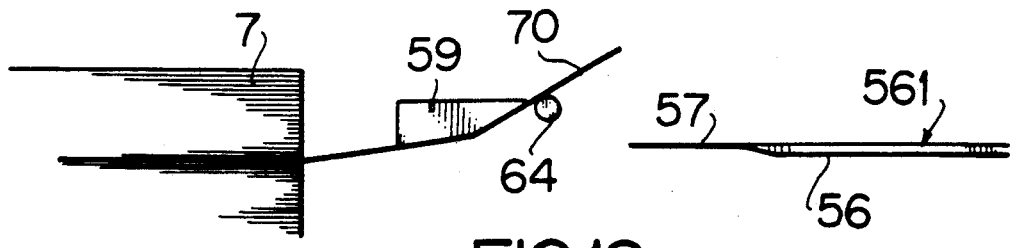
FIGS. 12*a*, 12*b*, 12*c*, 12*d* and 12*e* show how the insertion member is inserted into a pile of sheets.

In the condition shown in FIG. 12*a*, the insertion head 56 is about to be inserted. That is, one of the ream-marker tapes 70 sticking out of the pile of paper sheets 7 is controlled from above by the tongue guide 59, and, at the same time, has been raised by the holder 64 to an upper position, where it is retained so that the tongue 57 can be inserted with ease.

Figure 12B:
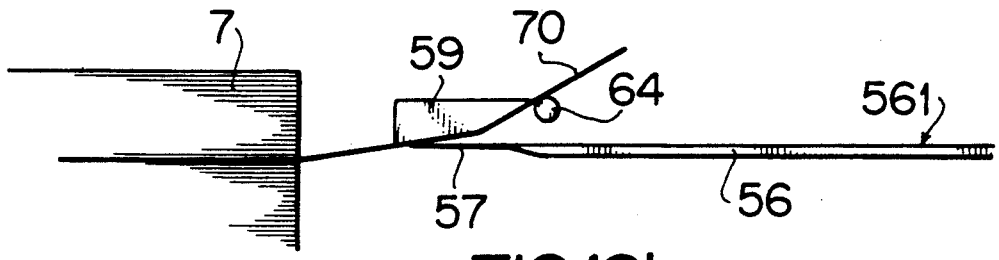

FIG. 12*b* shows the condition where the insertion head 56 has advanced to some extent, the tip of the tongue 57 being in contact with one of the ream-marker tapes 70.

Figure 12C:
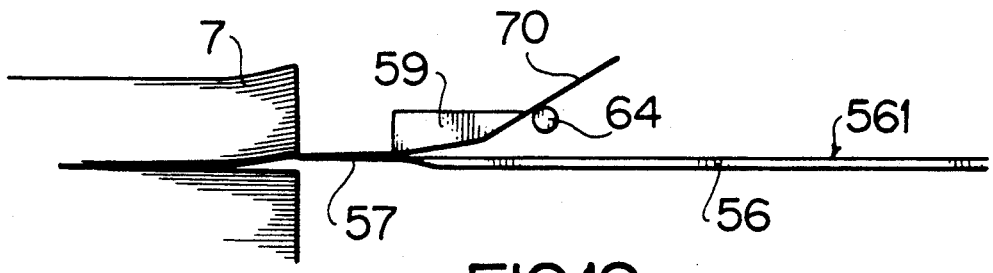

In the condition shown in FIG. 12*c*, the insertion head 56 has made a further advancement, the tip of the tongue 57 reaching the end surface of the pile of paper sheets 7.

In this condition, the ream of sheets to be distributed has been raised a little, the tongue 57 behaving in a manner like a seesaw around the tip of the insertion head 56. This allows the tongue 57 to be inserted into the pile of paper sheets 7 as it is guided by one of the ream-marker tapes 70.

Figure 12D:
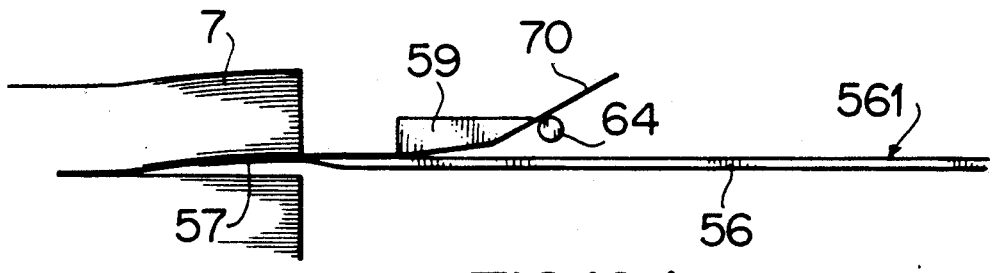

FIG. 12*d* shows the condition where the insertion head 56 has advanced still further, the tip of the insertion head 56 reaching the end surface of the pile of paper sheets 7. Since the tongue 57 is situated underneath one of the ream-marker tapes 70, there is scarcely any danger of the paper sheets being damaged.

Figure 12E:
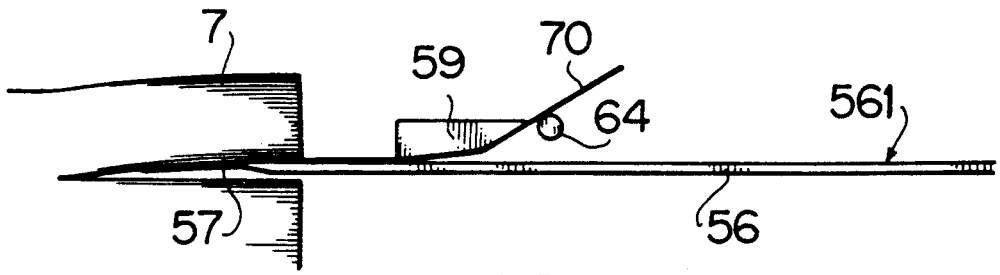

In the condition shown in FIG. 12*e*, the insertion head 56 has been completely inserted into the pile of paper sheets 7. Since the tongue 57 is made of a thin and elastic material, its tip section is curved, by the weight of the ream that has been raised, in accordance with the slope of the bottom surface thereof.

Figure 13:
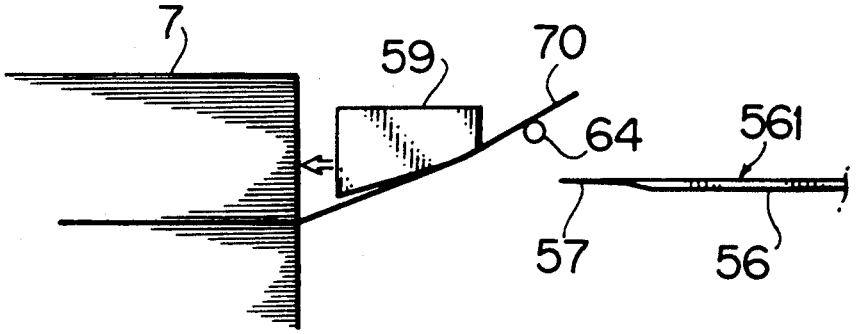
FIG. 13 shows the operation of a means for relieving the load on the insertion member due to the raised ream when it is inserted.

If the ream of paper sheets above one of the ream-marker tapes 70 is relatively thick, its heavy weight makes it difficult to insert the tongue 57, guided by one of the tapes 70, in a stable manner. To overcome this problem, some means may be contrived to reduce the load applied to the tongue 57. For example, an air outlet may be provided on the tongue guide 59. The air outlet, which is not shown in the accompanying drawings, is to be provided on that surface of the tongue guide 59 facing the pile of paper sheets 7. By blowing air against the sheets, as shown in FIG. 13, the load on the tongue 57 due to the weight of the sheets can be reduced, thereby facilitating the insertion of the insertion head 56.

Instead of providing it on the tongue guide 59, the air outlet may be provided on some other component (not shown). Apart from this, the load on the tongue 57 may be reduced by a mechanical means. That is, the ream above the insertion head 56 may be moved obliquely upwards by some mechanical means.

Figure 9:
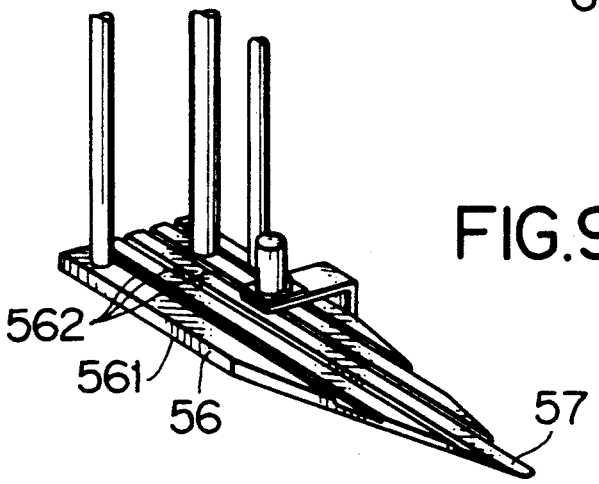
FIG. 9 is a perspective view of a separation means in accordance with another embodiment of this invention.

To realize a still more satisfactory separation of paper sheets, the insertion head 56 may be equipped with air-introduction passages 562 through which an air stream is provided when separating paper sheets (see FIG. 9).

The distribution means C is designed such that a plurality of forks are inserted under a ream of paper sheets separated from the rest of a pile of sheets by the separation means B, and at least one of the plurality of forks is first moved horizontally in a direction perpendicular to the direction in which the ream is distributed, all the plurality of forks being moved in the distributing direction afterwards. Specifically, the distribution means C may have the following construction (see FIG. 1):

The distribution means C may comprise a V-axis unit 22 arranged adjacent to the X-axis unit 11 through the intermediary of the guide and slider provided therein. This V-axis unit 22 can be moved transversely on the X-axis unit 11 by an air cylinder 23. Stationary (or movable) forks 24, 24 are arranged on both sides of the V-axis unit 22. Only one of these stationary forks 24, 24 is used at one time. The stationary fork 24 which is not being used may be horizontally rotated by 90° so that it will not interfere with the pile of paper sheets 7 (FIGS. 14*a* to 14*h*).

Figure 14A:
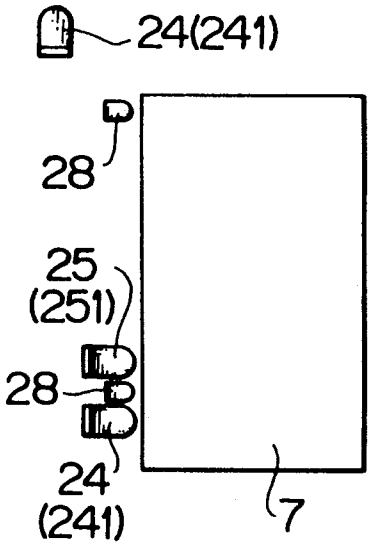
FIGS. 14*a*, 14*b*, 14*c*, 14*d*, 14*e*, 14*f*, 14*g* and 14*h*, illustrate the operation of the distribution means of the apparatus.

The V-axis unit 22 is equipped with a screw 27 which can be rotated by a movable-fork-drive motor 26. By operating this screw 27, a movable fork 25 can slide longitudinally. FIGS. 14*a* to illustrate how a ream of paper sheets 7 is distributed. This process will be described below.

Figure 14C:
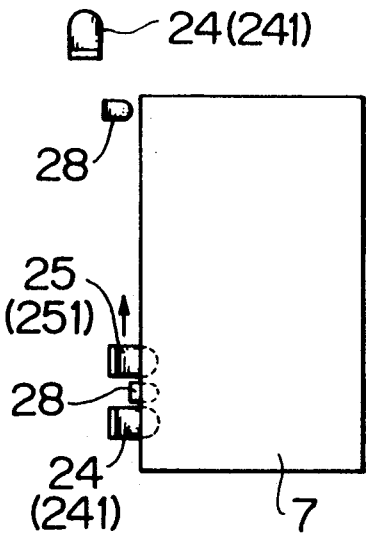
Figure 14E:
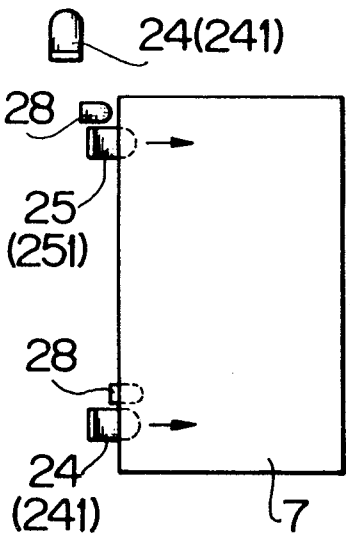
Figure 14G:
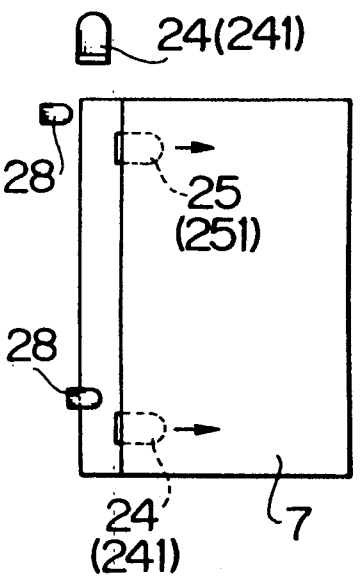
Figure 14B:
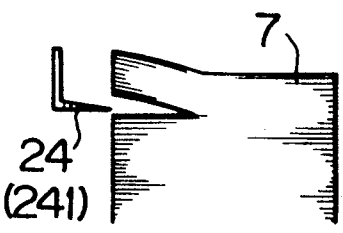

In the condition shown in FIG. 14*a* and 14*b*, the operation of distributing a ream of sheets is about to be started. Since in this condition the ream-marker tapes 70 are inserted into the pile at $M_1$ or $M_2$ of FIG. 7, only the stationary fork 24 which is on the right-hand side (as seen in the drawings) is used, the stationary fork 24 on the left-hand side being rotated horizontally by 90° so that it will not interfere with the pile of paper sheets 7. (The operation of thus rotating the stationary fork 24, which is performed manually, is not illustrated here.) Likewise, only the paper fixing member 28 which is on the right-hand side is used, the one on the left-hand side being kept out of operation. If it is arranged the other way around and the ream-marker tapes 70 are inserted into the pile at $M_3$ or $M_4$ of FIG. 7, only the stationary fork 24 and the paper fixing member 28 which are on the left-hand side are used.

The ream of paper sheets 7 to be distributed is separated from the rest of the pile by means of the insertion head 56. The stationary fork 24, the movable fork 25 and the paper fixing member 28 are then inserted between the gap formed between the ream and the rest of the pile.

Figure 14D:
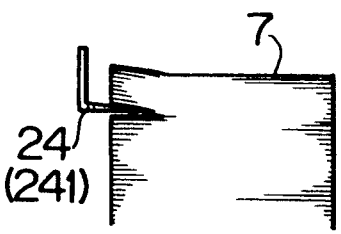

In the condition shown in FIGS. 14*c* and 14*d*, the V-axis unit 22 and the paper fixing member 28 have advanced a predetermined stroke, the paper fixing member 28 being lowered afterwards to fix the rest of the pile.

Figure 14F:
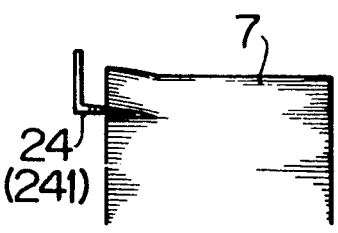

FIGS. 14*e* and 14*f* show the condition where the movable fork 25 has been moved to the left (as shown in the drawing).

Figure 14H:
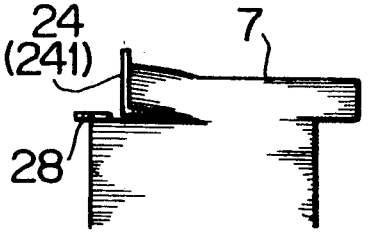

FIGS. 14*g* and 14*h* show the condition where the V-axis unit 22 has advanced another stroke, thus distributing one ream of paper sheets.

Meanwhile, the paper fixing member 28 keeps on pressing the rest of the pile so that it will not move during the process.

OPERATION

The operation of the apparatus of this invention having the above construction will now be described.

The method of separating paper sheets into units and distributing them using this apparatus comprises the steps of: raising a pile of paper sheets having markers for grouping them into reams along with the insertion member placed under the ream of sheets to be distributed; stopping the ascent of the pile of paper sheets upon detecting one of the above-described markers and further raising the insertion member so as to form a gap in the pile of paper sheets, into which the distribution forks are inserted in order to separate the ream of sheets from the rest of the pile; and distributing the ream of sheets by moving the forks forwards, and, at the same time, bringing the above-mentioned insertion member, which has been under the ream being distributed, to a position under the next ream of sheets which is to be separated and distributed.

When the pallet 6 carrying a pile of paper sheets 7 has been transferred to the conveyor 5, the raising means A is operated to raise the lifter 1. This ascent of the lifter 1 is stopped when the light emitters 60*a* and light receivers 60*b* of the mark sensors detect one of the ream-marker tapes 70. Since the weight of the raising means A varies from 1 to 2.5 tons, irregularity in the stop position thereof cannot be avoided by forced stopping only, which makes the apparatus inadequate for practical use. In view of this, a signal is transmitted from the mark sensors to a numerical control device (not shown) after the light emitters 60*a* and light receivers 60*b* thereof have detected one of the ream-marker tapes 70. This numerical control device changes the regular ascending movement of the lifter 1 into a speed-reduction movement through numerical control, and controls the servo motor 2 in such a manner that the lifter 1 is stopped at a certain distance from the position where the ream-marker tape 70 has been detected (It may be stopped at a position higher, for example, by 5 mm, than the position where the ream-marker tape 70 has been detected.).

Figure 15A:
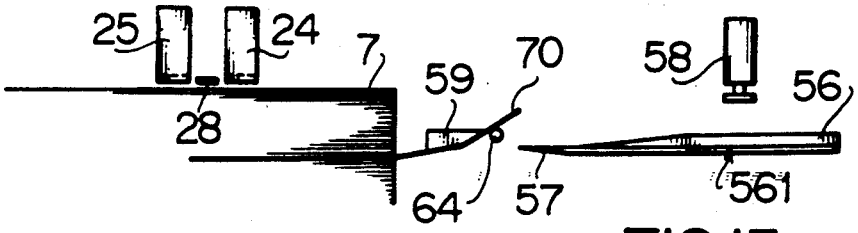
FIGS. 15*a*, 15*b*, 15*c*, 15*d* and 15*e* illustrate the operation of the separation means along with the synchronized operation it performs with the distribution means.

When the ascent of the lifter 1 has been stopped, the horizontal air cylinder 61 is brought into the full-in condition so that the holder 64 is brought, while keeping its lowest position, to a position below the ream-marker tape 70. By obliquely lifting the holder 64 by means of the vertical air cylinder 63, the ream-marker tape 70 is reliably raised, making it possible for the insertion head 56 to be inserted into the pile. This condition is shown in FIG. 15*a*.

Figure 15B:
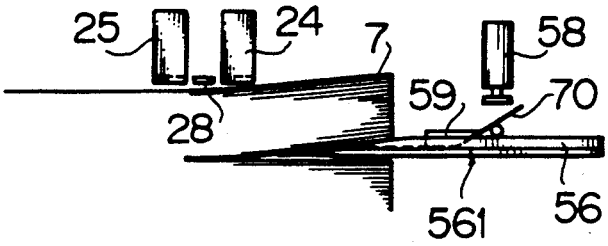
Figure 15C:
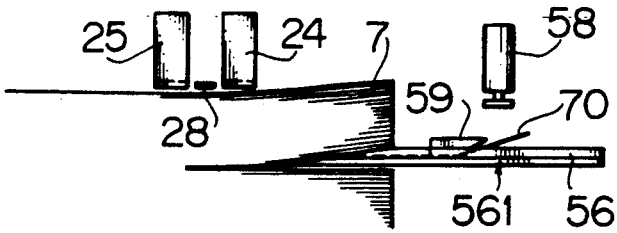

After the process illustrated in FIGS. 12*a* to 12*e*, the condition shown in FIG. 15*b* is attained. Afterwards, the horizontal air cylinder 61 is brought into the full-out condition, thereby allowing the ream-marker tape 70, which has been retained in a raised position, to come down. The condition is shown in FIG. 15*c*.

Next, the lifter 1 is raised, which causes the insertion head 56 to ascend. The ascent of the lifter 1 is stopped when the next ream-marker tape 70 is detected. By supplying air to the air cylinder 54 just before this stopping, the insertion head 56 stops at a position higher by a certain distance than the position where the lifter 1 has stopped. This condition is shown in FIG. 15*d*.

Thus, that portion of the pile of paper sheets which is above the ream-marker tape 70 is raised, thereby making it possible for the stationary fork 24, the movable fork 25 and the paper fixing member 28 of the distribution means C to enter the gap formed between the above-mentioned portion and the rest of the pile. If the distribution is to be performed at a rate of 12 to 15 reams per minute, it is far from enough for the insertion head 56 to be inserted into the pile after the pallet 6 has stopped its ascent. In view of this, the insertion head 56 is inserted into the pile prior to the ascent of the lifter 1. Thus, when the lifter 1 has stopped its ascent, the portion of the pile above the ream-marker tape 70 has already been raised still higher, as shown in FIG. 15*d*, so that the distribution means C can operate immediately. Thus, the operation time is reduced to the utmost.

Figure 15D:
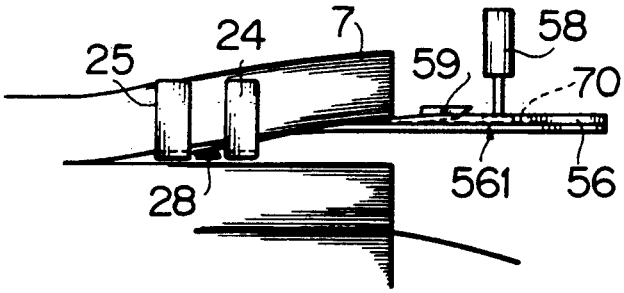

In the condition shown in FIG. 15*d*, the ream-marker tape 70 is already reliably held by the marker holder 58. Then, the distribution means C first advances for a certain distance. Afterwards, the movable fork 25 is moved away from the stationary fork 24, and, at the same time, the paper fixing member 28 is lowered so as to fix the rest of the pile. Simultaneously with these operations, the insertion head 56 is extracted from the pile. Since the ream-marker tape 70 is held by the insertion head 56, it is drawn out of the pile together with the head. This causes the tongue guide 59 to be lowered by its own weight and made ready for the next insertion movement.

In the condition shown in FIG. 15*e*, the cylinder 61 for horizontally moving the holder 64 has been brought into the full-in condition, thereby bringing the holder 64 to a position immediately below the ream-marker tape 70. The air cylinder 63 for vertically moving the holder is then brought into the full-in condition, thereby raising the holder 64 so that it will hold the ream-marker tape 70. Extracted from the pile, the insertion head 56 descends. The ream-marker tapes 70 drawn out of the pile are blown away by an air nozzle provided separately, and are gathered afterwards.

Before blowing away a ream-marker tape 70, the tape sensor 69 confirms its existence. After blowing away the tape, it confirms the absence of the same, getting ready for the next operation.

Thus, the condition shown in FIG. 15*a* is attained.

Figure 15E:
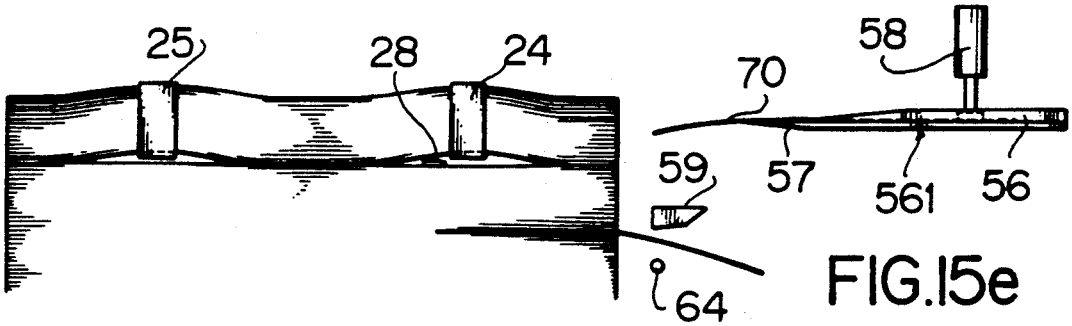

Meanwhile, the distribution means C has further advanced from the position of FIG. 15*e*, i.e., the position shown in FIG. 14*e* to the one shown in FIG. 14*g* thus distributing one ream of sheets. During this process, air is blown out through the tips of the stationary fork 24 and the movable fork 25, inserted into the gap between the bottom surface of the ream to be distributed and the top surface of the rest of the pile, thereby allowing the ream to be distributed smoothly.

The distributed ream is received by the ream wrapping machine E, which outputs a reception-complete signal. While distributing the ream, the insertion head 56 makes the next insertion movement. Upon the completion of this movement and the output of the above-mentioned reception-complete signal, the lifter 1 starts ascending. By repeating this process, reams of paper sheets are successively conveyed to the ream wrapping machine E.

Figure 3:
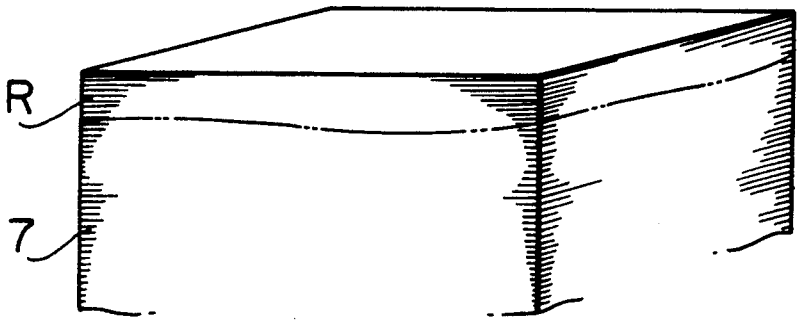
FIG. 3 shows the state where a pile of paper sheets on a pallet are curved.

In the above example, the forks 24 and 25 do not move in the vertical direction while distributing reams. However, it is also possible to adopt vertically movable forks 241 and 251, which are shown in FIGS. 17 to 20. These fork are useful when the pile of paper sheets is curved as shown in FIG. 3. In that case, the first and second forks 241 and 251 can vertically move, as they make a distributing movement, in accordance with the piling condition of the paper sheets, thereby avoiding damage to the paper sheets.

The second fork 251 shown in FIG. 17 is mounted on a fork substrate 96 through the intermediary of an elastic member 95.

Instead of the elastic member 95, rubber members 123 as shown in FIG. 20 may be employed. (The first fork 241 is attached to a fork substrate 96 through a plate 99 by means of a bolt 111.) A slide cylinder 97 is mounted on the fork substrate 96 in such a manner as to be slidable in the vertical direction. The slide cylinder 97 is connected with the second fork 251 through a fixing plate 98. The side-edge section of the second fork 251 is rounded so that it will not damage the paper sheets. Air outlets 120 and 121 for blowing out air are provided on the side surface of the fork 251.

When distributing the ream of sheets on top of a pile of paper sheets, the first and second forks 241 and 251 first advance simultaneously (FIGS. 14*a* and 14*d*), as in the above-described embodiment. Then, the second fork 251 moves horizontally in a direction perpendicular to the direction in which the paper sheets are distributed (to the left as seen in the drawings). As stated above, the second fork 251 is vertically movable, so that, if the pile of sheets is curved (FIG. 3), the fork moves vertically in accordance with the condition of the sheets, thereby avoiding damage to the sheets. Damage to the sheets can be further avoided by blowing out air in the fork moving direction through the air outlets 120 provided in the side surface of the second fork 251.

By combining the ability of the second fork 251 to move vertically with the effect of the air stream from the air outlets 120 thereof, damage to the sheets can be avoided more effectively. The first and second forks 241 and 251 move simultaneously from the position shown in FIG. 14*e* in the direction indicated by the arrows (FIG. 14*g*), thereby conveying one ream of sheets to the ream wrapping machine E.

In the condition shown in FIG. 14*e*, the lower surface of the sheet at the bottom of the uppermost ream is in contact with the upper surfaces of the first and second forks 241 and 251, and the lower surfaces of these forks are in contact with the upper surface of the sheet on top of the next ream. This is not desirable since the lower surfaces of the forks can damage the upper surface of the topmost sheet of the next ream. To avoid this, the topmost ream is raised to some extent by means of the slide cylinder when conveying this ream to the ream wrapping machine E (FIG. 14*g*, which keeps the lower surfaces of the forks out of contact with the topmost sheet of the next ream, thereby avoiding damage to the sheet below.

Instead of providing air outlets 120 on the side surface of the second fork 251, air outlets 122 and 123 may be provided on the upper and lower surfaces of the same, as shown in FIGS. 18 and 19.

Thus, with the distribution means of this invention, a plurality of forks are inserted into a gap formed between a ream of paper sheets separated from a pile by the separation means and the rest of the pile, and at least one of the plurality of forks is first moved horizontally in a direction perpendicular to the direction in which the sheets are conveyed by the forks, moving all the forks in the sheet-distributing (conveying) direction afterwards. Thanks to this arrangement, the separation of paper sheets can be effected in a satisfactory manner, without damaging the sheets. In addition, the forks can move vertically if the pile of sheets is curved as shown in FIG. 3, thus avoiding damage to the paper sheets. In such cases, damage to the sheets can also be avoided by blowing out air in the fork moving direction through air outlets provided on the side surface of the fork.

Furthermore, since in the apparatus of this invention the markers consist of ream-marker tapes, and the separation means is composed of an insertion member and a device for raising the ream-marker tapes, the insertion member can be inserted into a pile of paper sheets using the lower surface of each ream-marker tape as a guide, which makes it possible to separate paper sheets into reams in a satisfactory manner without damaging them.

Further, the method of this invention is such that, while a ream of paper sheets is being distributed, the insertion member is brought under the ream to be separated and distributed next, thus shortening the operation cycle.

What is claimed is:

1. An apparatus for separating paper sheets into units and distributing them in a distribution direction, comprising:

a raising means for raising to a certain height a pile of paper sheets having markers for grouping them into reams;

a separation means for vertically separating said pile of paper sheets into reams in accordance with said markers; and a distribution means having a plurality of forks to be inserted into a gap formed between a ream of paper sheets separated from said pile by said separation means and the rest of said pile, at least one of said plurality of forks being first moved horizontally, when in said gap, in a direction perpendicular to the direction in which said ream is distributed without moving said ream, all of said plurality of forks being moved afterwards in the direction to distribute said ream in the distribution direction.

2. An apparatus as claimed in claim 1, wherein the plurality of forks of said distribution means consist of two types of fork, one of which is a movable fork that is supported in such a manner as to be movable in the vertical direction.

3. An apparatus as claimed in claim 1, wherein the plurality of forks of said distribution means consist of two types of fork, both of which are supported in such a manner as to be movable in the vertical direction.

4. An apparatus as claimed in claim 1, wherein the plurality of forks of said distribution means consist of two types of fork, one of which is a movable fork that has on an outer peripheral section air outlets for blowing out air.

5. An apparatus as claimed in claim 1, wherein the plurality of forks of said distribution means consist of two types of fork, one of which is a movable fork having on its upper and lower surfaces air outlets for blowing out air and supported in such a manner as to be movable in the vertical direction.

6. An apparatus as claimed in claim 1, wherein said separation means consists of an insertion member which is equipped with air-introducing passages.

7. An apparatus for separating paper sheets into units and distributing them, comprising the steps of:

raising a pile of paper sheets having markers for grouping the paper sheets into reams along with an insertion member which is positioned under a ream of paper sheets to be separated from said pile and distributed;

stopping the ascent of said pile of paper sheets and further raising said insertion member so as to form in said pile a gap into which distribution forks are inserted; and distributing said ream of paper sheets by advancing said distributing forks, and meanwhile bringing said insertion member under the next ream of paper sheets that is to be separated from said pile and distributed.

* * * * *